United States Patent [19]

Barros

[11] Patent Number: 4,631,864

[45] Date of Patent: Dec. 30, 1986

[54] BOWDEN CABLE-WINDOW LIFTER, ESPECIALLY FOR MOTOR VEHICLES

[75] Inventor: Manuel Barros, Coburg, Fed. Rep. of Germany

[73] Assignee: Brose Fahrzeugteile GmbH & Co. KG, Coburg, Fed. Rep. of Germany

[21] Appl. No.: 769,179

[22] Filed: Aug. 26, 1985

[30] Foreign Application Priority Data

Aug. 31, 1984 [DE] Fed. Rep. of Germany ..... 3432178

[51] Int. Cl.[4] ..... E05F 11/48

[52] U.S. Cl. ..... 49/352; 242/157.1

[58] Field of Search ..... 242/117, 157.1; 254/374; 49/352

[56] References Cited

U.S. PATENT DOCUMENTS 4,045,001 8/1977 Harvey, Jr. ..... 242/157.1 X

FOREIGN PATENT DOCUMENTS

GM8234362.4 6/1983 Fed. Rep. of Germany .

*Primary Examiner*—Kenneth Downey

*Attorney, Agent, or Firm*—Barnes & Thornburg

[57] ABSTRACT

A Bowden cable-window lifter for motor vehicles which includes a cable drive, at the housing of which is supported a cable drum adapted to be driven. The cable is guided in a closed loop starting from the cable drum to an entrainment member carrying the window and back to the cable drum. The cable sections starting from the housing are each guided in a Bowden casing, whereby the Bowden casing-end supported at the housing by way of a connecting member and the cable drum are displaceably supported relative to one another in the direction of the drum axis in such a manner that with a rotation of the cable drum the instantaneous cable starting point of the cable section at the drum always assumes essentially the axial position. In order to achieve this displaceability with simple structural means, the respective connecting member is movably supported at the housing essentially parallel to the drum axis. The cable takes along the respective connecting member during a cable drum rotation.

7 Claims, 11 Drawing Figures

FIG. 3
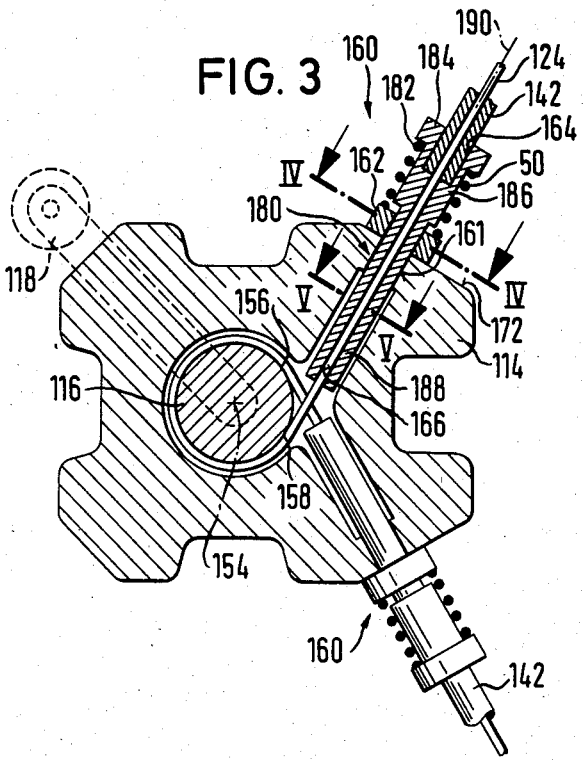
FIG. 4
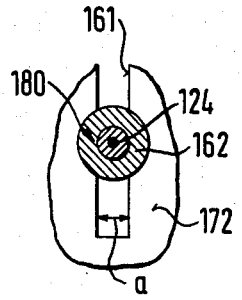
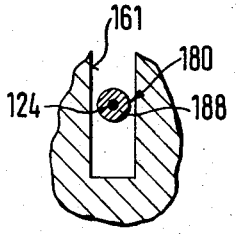
FIG. 5
FIG. 6
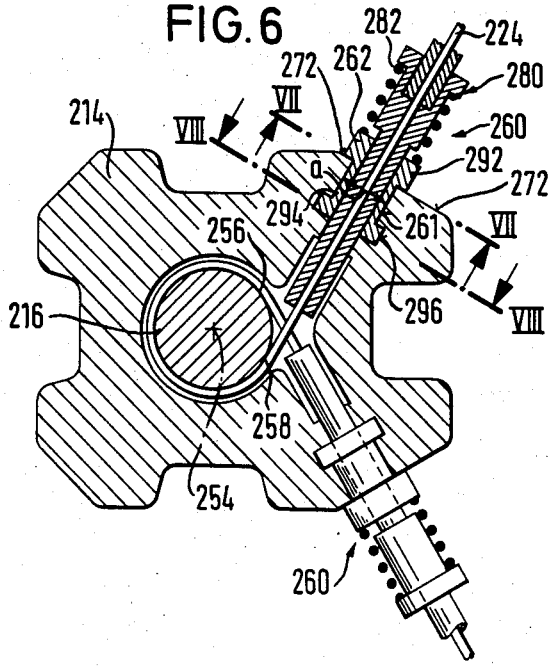
FIG. 7
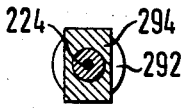
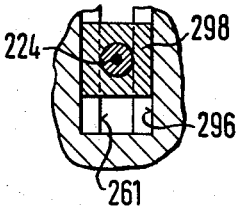
FIG. 8

BOWDEN CABLE-WINDOW LIFTER, ESPECIALLY FOR MOTOR VEHICLES

The present invention relates to a Bowden cable-window lifter, especially for motor vehicles, including a cable drive, in the housing of which is supported a cable drum adapted to be driven and provided with helical cable grooves on the outside thereof, an entrainment member carrying a windowpane which is movably supported in the lifting direction at a guide installation, and a cable starting from the cable drum, possibly in a closed loop to the entrainment member and returned to the cable drum, whose cable section, respectively, cable sections extending between housing and guide installation are each guided in a Bowden casing or conduit, whereby the Bowden casing end supported at the housing by way of a connecting member and the cable drum are adapted to be displaceably supported relative to one another in the direction of the drum axis in such a manner that during a rotation of the cable drum the instantaneous cable starting point of the cable section always assumes essentially the same axial position at the drum (in relation to the drum axis) as the connecting element.

In the known Bowden-cable window lifter of this type (DE-OS No. 24 11 894) the cable drum is supported on a threaded bolt with the same pitch as the cable grooves. During a rotation of the cable drum the drum is displaced in such a manner that the cable starting point of the cable section guided through the connecting member fixed at the housing essentially does not change its position relative to the connecting member. The cable therefore always runs onto the cable drum (respectively off the cable drum) approximately in a radial plane relative to the drum axis. Without this measure the cable would run onto the cable drum more or less obliquely dependent on the window lifter position. If the cable extends between the connecting member and the cable drum in a center window lifter position, for example, in the radial plane, then an angle results between the cable and the radial plane in the two window lifter end position of up to $\pm 15°$. This angle would increase the friction between the cable and the connecting member as well as additionally between the cable and the cable drum grooves respectively the adjacent cable windings still resting on the cable drum. This is avoided by the known measures according to the DE OS No. 24 11 894. However, the relatively complicated construction as well as the necessarily enlarged housing for the cable drum are disadvantageous in this prior art arrangement.

It is the object of the present invention, in contrast thereto, to provide a Bowden cable-window lifter of the aforementioned type having a simplified construction and a compact housing.

The underlying problems are solved according to the present invention, in that the connecting member is movably supported at the housing parallel to the drum axis.

In order to be able to compensate for manufacturing inaccuracies and to be able to compensate also for a lengthening of the cable during use, the cable is prestressed, for the most part by means of at least one elastic spring element setting the Bowden casing under compressive prestress. In order to achieve now without further measures that the connecting member moves along with the traveling cable starting point during the rotation of the cable drum, it is proposed according to the present invention that the connecting member be provided with a slide element which abuts at a slide surface of the housing that is essentially parallel to the drum axis. By reason of the prestress, the cable always seeks to take the shortest possible path. In order to avoid the cable bent within the area of the connecting member which occurs during a displacement of the cable starting point with a non-displaced connecting member, the connecting member is taken along by the cable whereby the slide element slides along the slide surface with low friction resistance.

For enhancing the entrainment effect it is proposed that the connecting member is formed with a rigid casing extention, preferably in one piece with the slide element, which terminates within the area between slide surface and cable starting point, preferably near the cable starting point. The connecting member which in a first embodiment of the present invention is tiltably guided in the movement plane of the connecting member within a guide slot, is instantaneously tilted together with the casing extension by reason of the resulting relatively high torque (for example, about a tilting axis lying in the slide surface). Since the slide element under the cable prestress now presses against the slide surface, at an inclination, a force component will result which seeks to displace the slide element in the desired direction. In a somewhat more costly but particularly reliable alternative embodiment, the connecting member is safely guided in the guide slot against tilting in the movement plane of the connecting member. During a rotation of the cable drum with corresponding displacement of the cable starting point, a relatively high force component for the movement of the connecting parallel to the axial direction would result with a non-displaced connecting member by reason of the relatively large angle which occurs between the longitudinal axis of the casing extension and the longitudinal direction of the cable between casing extension and cable drum which occurs. The connecting member is therefore taken along by the cable already with a relatively small displacement of the cable starting point.

In order to obtain a tilting-safe guidance with simple means, a tongue and groove guidance is proposed for the connecting member with a groove longitudinal direction parallel to the drum axis. Provision may be made thereby that the slide element is provided with at least one guide projection which engages in a guide groove formed in a sidewall of the guide slot.

A further possibility to assure entrainment of the connecting member consists according to the invention in that the connecting member, possibly the slide element, is taken along by the cable drum by a direct or indirect engagement into the drum cable grooves.

A particularly simple construction with good entrainment effect is achieved in that the connecting member is provided at its end nearest the cable drum with an entrainment nose portion in the cable grooves.

However, one can also use an entrainment member supported at the cable drum and engaging in the cable grooves, with which the connecting member is coupled. Particularly preferred is the use of an entrainment member formed by a wire loop which is placed about the cable drum in one of the cable groove threads of the at least doublethread cable drum and whose one end is coupled with the connecting member.

In those cases in which the cable is guided in a closed cable loop, the connecting members of both Bowden casings supported at and starting from the housing, are advantageously movably supported at the housing in the manner indicated hereinabove. One is then able to get along with a single entrainment member if the other end of the wire loop forming the entrainment member is coupled with the connecting member of the second Bowden casing.

Finally, it is proposed according to the present invention that a connecting member is inserted into the slide element displaceable in the longitudinal direction of the cable section, and in that the spring element is installed between slide element and Bowden casing end portion. One obtains thereby the desired prestress with considerable spring hysteresis stroke.

These and other objects, features and advantages of the present invention will become more apparent from the following description when taken in connection with the accompanying drawing which shows, for purposes of illustration only, several embodiments in accordance with the present invention and wherein:

FIG. 3 is a simplified cross-sectional view through a modified cable drive housing in accordance with the present invention, taken perpendicularly to the drum axis and along the line III—III of FIG. 2;

FIG. 4 is a cross-sectional view, taken along line IV—IV of FIG. 3;

FIG. 5 is a partial cross-sectional view taken along line V—V of FIG. 3;

FIG. 6 is a cross-sectional view, similar to FIG. 3, of a further embodiment in accordance with the present invention;

FIG. 7 is a cross-sectional view, taken along line VII—VII of FIG. 6;

FIG. 8 is a partial cross-sectional view taken along line VIII—VIII of FIG. 6;

Figure 1:
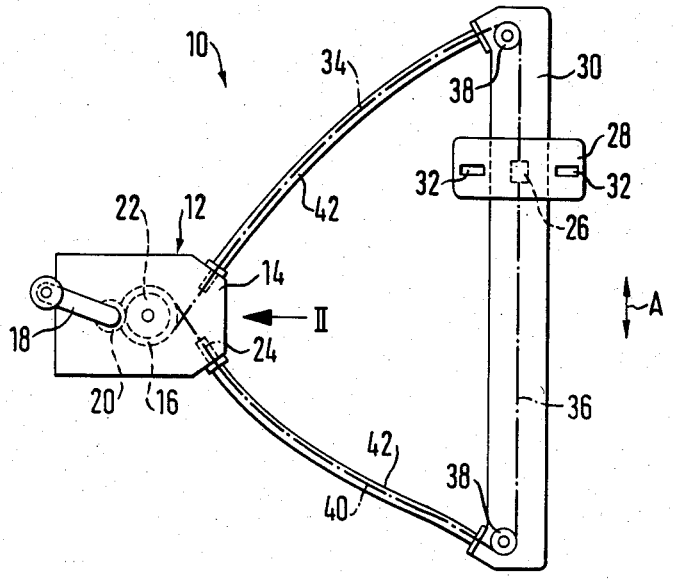
FIG. 1 is a simplified overall view of a Bowden cable-window lifter constructed in accordance with the present invention.

Referring now to the drawing wherein like reference numerals are used throughout the various views to designate like parts, the Bowden cable-window lifter illustrated in FIG. 1 which is generally designed by reference numeral 10, includes a cable drive generally designated by reference numeral 12, in the housing 14 of which is supported a cable drum 16. The cable drum 16, in turn, is driven by a handcrank 18, as indicated simplified in FIG. 1. A pinion 20 nonrotatably connected with the handcrank 18, engages in a gear 22 nonrotatably connected with the cable drum 16. The handcrank may also be nonrotatably connected directly with the cable drum (see FIG. 3). The cable 24 placed over the cable drum 16 which is indicated in FIG. 1 in dash and dotted lines, engages at an entrainment member 28 by way of a cable nipple 26.

The cable nipple 26 is displaceably supported on a guide rail 30 parallel to the lifting direction (double arrow A). The entrainment member 28 carries a windowpane (not shown). Elongated apertures 32 of the entrainment member 28, which are indicated in FIG. 1, serve for the connection with the windowpane respectively with an interconnected lifter rail. The cable is guided in a closed loop, and more particularly, starting from the cable drum 16, in a first cable section 34 to the upper end of the guide rail 30, thereafter in a second cable section 36 between deflection rollers 38 at both guide rail ends and finally in a third cable section 40 between the lower guide rail end and the cable drum. The cable section 36 extends freely between the deflection rollers 38; the two cable sections 34 and 40, in contrast, are guided in Bowden casings 42 which are each supported, on the one hand, at the housing 14 and on the other, at the respective guide rail end. The cable 24 is stressed in a conventional manner in that one or both Bowden casings 42 are set under compressive prestress by means of elastic spring elements (for example coil spring 50 in FIG. 3).

In lieu of an entrainment member displaceable along a guide rail according to FIG. 1, also a Bowden cable-window lifter with another type of entrainment guidance may be used, for example, a linkage window lifter, especially a scissor-window lifter, in which the cable is guided at least in one cable section through a Bowden casing terminating at the housing.

Figure 2:
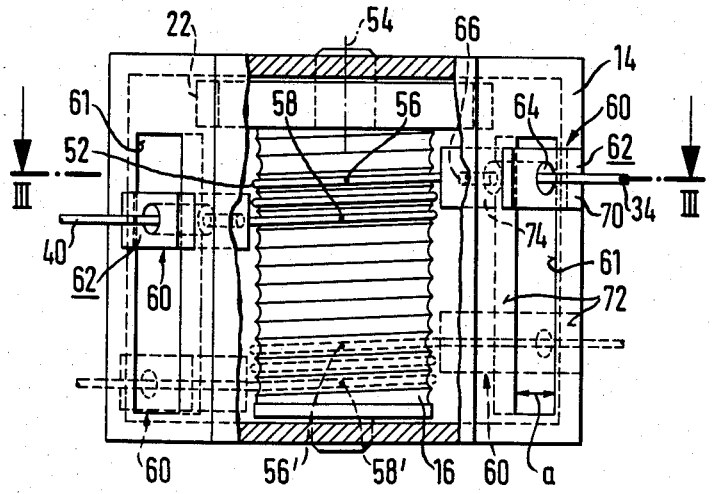
FIG. 2 is a partial view, partly in cross-section, on the cable drive of the window lifter in FIG. 1, taken in the direction of arrow II.

The one or several windings 52 of the endless cable 24 which are placed about the cable drum 16, are displaced in the direction of the drum axis 54 with a rotation of the cable drum 16 during a window lifter actuation. The cable starting point 56 of the cable section 34 as well as the cable starting point 58 of the cable section 40 (FIG. 2) are displaced correspondingly whereby one of the points represents the point where the cable starts to run onto the cable drum and the other point where the cable starts to run off the cable drum, depending on the direction of rotation. The term "cable starting point" is understood herein as that spatial point at which the cable leaving the cable drum 16 last contacts the cable drum.

In order to assure that the cable is able to run off from the respective starting point in a plane perpendicular to the axis 54, without directional deflection by the connecting member generally designated by reference numeral 60 and supported at the housing 14, the connecting member 60 is movably supported in each case in a longitudinal slot 61 in the housing 14 in a direction parallel to the drum axis 54. The connecting member 60 is constructed in the simplified version according to FIG. 2 as slide member 62 provided with a dead end bore-like mounting opening 64 for the Bowden casing 42, properly speaking. For purposes of guiding the cable 24 through the slide member 62, a corresponding bore 66 extends through the slide member 62. For purposes of simplification of the illustration, the Bowden casing has been omitted in FIG. 1. The slide member 62 is provided with a slide member head portion 70 which overlaps the two longitudinal edges of the guide slot 61 on the outside of the housing and abuts at these longitudinal edges corresponding to the cable prestress. These longitudinal edges therefore constitute slide surfaces 72 for the slide member 62. The section 74 of the slide element 62 which extends into the guide slot 61 is matched in its width to the width a of the guide slot 61. If the drum 16 is now rotated for lifting, respectively, lowering the window, for example in such a manner that the cable windings have now arrived at the lower end of the cable drum 16 as viewed in FIG. 2, then the two slide members 62 are displaced corresponding to the displacement of the cable starting point (displaced position 56', 58'). The cause for entrainment of the two slide elements and therewith of the two connecting members 60 resides in that the cable 24 which is under prestress seeks to realize as rectilinear and as bending-free a course as possible.

Since the two cable sections 34 and 40 therefore extend always in radial planes from the cable drum 16 and are continued to be guided free of bending through the connecting members, minimal friction losses and wear appearances will occur at the mutually frictionally engaging structural parts, namely the cable 24, the cable drum 16 as well as the connecting members 60.

A second embodiment of the invention is illustrated in FIGS. 3 to 5, whereby only those details are illustrated which concern the displaceable support of the connecting member. FIG. 3 corresponding to a cross-section taken along line III—III of the first embodiment according to FIGS. 1 and 2. Parts of the embodiment according to FIGS. 3 to 5 which correspond in their function to the parts of the first embodiments are designated with the same reference numerals, however of the 100 series. The housing which is therefore designated by reference numeral 114, supports the cable drum 116 which is adapted to be driven by a handcrank 118 only indicated schematically in dash-lines. In contrast to the one-piece connecting member 60 (slide member 62), the connecting member generally designated by reference numeral 160 according to FIGS. 3 to 5 is constructed three-partite, namely with a slide member 162 in the form of a ring, with a Bowden casing-end portion generally designated by reference numeral 180 inserted into the slide element 162 and with a spring element 182 in the form of a coil compressing spring. The Bowden casing-end portion 180 is constructed as cylindrical stepped bolt with an end section 184 opposite the housing 114, with a section 186 of reduced diameter and adjoining the section 184 in the direction toward the housing, and with a further section 188 extending up to the other end whose diameter is matched to the slot width a of the guide slot 161. The radial shoulder formed between the sections 180 and 182 serves as abutment surface for the spring element 182 which is supported with its other end at the slide element 162. The radial shoulder formed between the sections 186 and 188 forms an abutment for the insert movement of the Bowden casing-end portion 180 into the guide slot 161. The Bowden casing-end portion 180 is provided at its outer end with a dead end bore-like mounting opening 164 for the corresponding end of the Bowden casing 142. The cable 124 extends through the Bowden casing-end portion 180 in a continuous axial bore 166. The spring element 182 produces the cable prestress and compensates for changes in cable length during the use.

The connecting member 160 for the lower Bowden casing 142 in FIG. 3 has the same construction as the upper connecting member 160.

During a rotation of the cable drum 116 for lifting or lowering the window, the two connecting members 160 are taken along by the cable 124 corresponding to the displacement of the respective cable starting point 156, respectively 158. More specifically, if the cable starting points are displaced without corresponding taking-along of the connecting members, then an increasing tilting of the longitudinal axes of the connecting members with respect to a radial plane (in relation to the drum axis 154) will result. The slide element 162 which is consequently pressed at an inclination against the slide surface 172 on both sides of the guide slot 161 at the housing outside, produces a force component which seeks to displace the Bowden casingend portion 180 in the desired direction until the longitudinal axis 190 of the Bowden casing-end portion 180 is essentially perpendicular to the slide surface 172.

FIGS. 6 to 8 illustrates a somewhat modified further embodiment in which parts which correspond in their function to the parts of the embodiment according to FIGS. 3 to 5 are designated with the same reference numerals of the 200 series.

The connecting member generally designated by reference numeral 260 is again three-partite with a slide element 262, with a Bowden casing-end portion 280 as well as with a spring element 282 which acts between the slide element 262 and the Bowden casing end portion 280 in the sense of distancing the Bowden casing-end portion 280 from the housing 214. The Bowden casing-end portion 280 has the same form as the Bowden casing-end portion 180. The slide element 262, in contrast, includes in addition to a ring shaped outer end section 292, a center section 294 rectangular in the cross-section of FIG. 7, which is matched in its width to the slot width a and extends partly through the guide slot 261, as well as an inner end section 298 which is also rectangular in the cross-section of FIG. 8, and engages in two mutually opposite guide grooves 296 of the guide slot 261. The ring-shaped outer end section 292 therefore abuts on the slot edges forming the slide surfaces 272 corresponding to the ring shaped slide element 162 in FIGS. 3 and 4 on both sides of the guide slot opening. This slide surface 272 extends accurately perpendicularly to the longitudinal direction to the cable 224 insofar as the cable 224 runs off the cable drum 216 completely stretched in a radial plane in relation to the drum axis 254.

The end section 298 engaging in the two guides grooves 296 forms a tongue and groove guidance for the connecting member 280 with a groove longitudinal direction parallel to the drum axis 254. Possibly a slight clearance is provided between the guide groove 296 and the end section 298 in order to avoid a jamming.

The described tongue and groove guidance improves the entrainment effect because a residual inclination of the connecting member 280 with respect to the radial surface which is possible in the embodiment according to FIGS. 3 to 5, is now precluded. As soon as the corresponding cable starting point 256 respectively 258 leads the coordinated connecting member 260 in the axial direction, the prestressed cable 224 exerts on the inner end of the Bowden casing-end portion 280 a relatively high force component parallel to the drum axis 254 which displaces the Bowden cable-end portion and together with the latter the connecting member 260 in the desired direction and extent.

Figure 9:
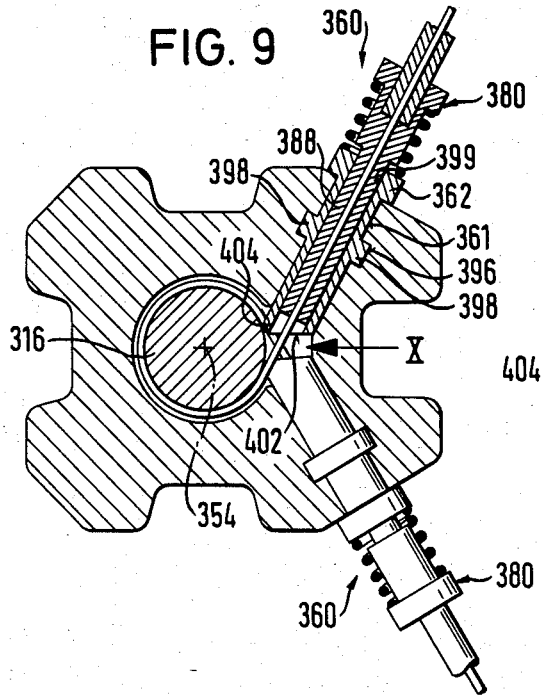
FIG. 9 is a cross-sectional view, similar to FIGS. 3 and 6, through a still further modified embodiment in accordance with the present invention.
Figure 10:
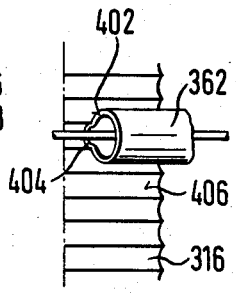
FIG. 10 is a partial detail view on the cable drum within the area of the connecting member of the arrangement according to FIG. 9, taken in the direction of arrow X.

In the embodiment of the invention illustrated in FIGS. 9 and 10, the same reference numerals are again used to designate corresponding parts of the embodiment of FIGS. 3 to 5, however of the 300 series. The Bowden casing-end portion which is therefore generally designated by reference numeral 380 of the connecting member generally designated by reference numeral 360 which is again of three-partite construction, has the same form as the connecting member 160. The slide element 362 corresponds to the slide element 262 according to FIGS. 6 to 8 with the one difference that it is extended toward the cable drum 316 directly up to the cable drum outer circumference. Like the slide element 262 also the slide element 362 is also provided with a central through-opening 399, into which the Bowden casing-end portion 380 is axially displaceably inserted with its inner section 388.

The inner end of the slide element 362 is bevelled off according to FIGS. 9 and 10; the resulting end face 402 lies approximately in a plane containing the drum axis 354. The thus formed tip of the slide element 362 is formed as entrainment nose portion 404 which engages in one or several cable grooves 406 of the cable drum 316 so that with a cable drum rotation it is taken along in the direction of the drum axis 354 by the corresponding cable groove 406. By reason of the tongue and groove guidance (guide grooves 396 inside of the guide slot 361; guide projections formed by the section 398 of the slide element 362) the slide element 362 cannot escape by tilting with the consequence that the entrainment nose portion 404 would come out of contact with the corresponding cable groove 406. The slide element 362 and with the latter the overall connecting member 360 are therefore taken along in the desired manner.

Figure 11:
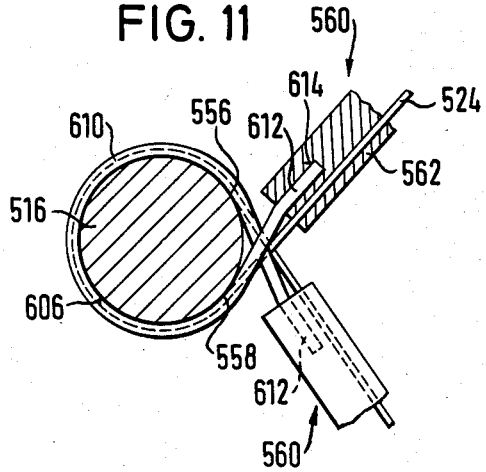
FIG. 11 is a cross-sectional view, similar to FIGS. 3, 6 and 9, through still another embodiment in accordance with the present invention, omitting for the sake of simplicity, the housing.

Finally a still further embodiment is illustrated in FIG. 11, omitting for sake of simplicity the housing, in which the entrainment of the connecting member generally designated by reference numeral 560 does not take place by direct engagement in the cable grooves of the cable drum but indirectly by way of an entrainment member constructed as wire loop 610 and surrounding the cable drum 516. The wire loop 610 is placed into a cable groove 606 of the cable drum 516. The cable drum is of at least two-threaded construction so that the cable 524 can be inserted into the adjacent cable groove. The two ends 612 of the wire loop 610 are slightly bent outwardly and are inserted into an insert opening 614 at each inner end of the two slide elements 562. With their remaining non-illustrated construction the slide elements 562 may correspond to the slide element 62, 262 or 362 whereby a construction according to slide element 362 is preferred because the tongue and groove guidance prevents beforehand a tilting which could have as a consequence a movement of the wire loop 610 and the slide element 562 away from one another.

The wire loop 610 is displaced in the axial direction during a cable drum rotation in the axial direction in the same manner as the cable starting points 556, respectively 558, because the cable loops 610 is not rotated along. The two cable ends 612 therefore take along correspondingly the connecting members 560.

While I have shown and described several embodiments in accordance with the present invention, it is understood that the same is not limited thereto but is susceptible of numerous changes and modifications as known to those skilled in the art and I therefore do not wish to be limited to the details shown and described herein, but intend to cover all such changes and modifications as are encompassed by the scope of the appended claims.

I claim:

1. A Bowden cable-window lifter comprising cable drive means including housing means and cable drum means having helical cable grooves and supported in said housing means, entrainment means carrying a window which is movably supported in the lifting direction at a guide means, and cable means starting from the cable drum means to the entrainment means and guided back to the drum means, at least one of the cable sections extending between the housing means and the guide means being guided in a Bowden casing means, connecting means supporting one Bowden casing end at the housing means, said Bowden casing end and the cable drum means being displaceably supported relative to one another in the direction of the drum axis in such a manner that with a rotation of the cable drum means, the instantaneous cable starting point of the cable section at the drum means assumes always essentially the same axial position in relation to the drum axis as the connecting means, wherein the connecting means is taken along by the cable drum means during rotation of the drum means, by direct engagement in the drum groove, and means movably supporting the connecting means at the housing means essentially parallel to the drum axis.

2. A Bowden cable-window lifter comprising cable drive means including housing means and cable drum means having helical cable grooves and supported in said housing means, entrainment means carrying a window which is movably supported in the lifting direction at a guide means, and cable means starting from the cable drum means to the entrainment means and guided back to the drum means, at least one of the cable sections extending between the housing means and the guide means being guided in a Bowden casing means, connecting means including an entrainment nose portion engaging in the cable grooves at the end of the connecting means nearest the cable drum means and supporting one Bowden casing end at the housing means, wherein the connecting means is taken along by the cable drum means during rotation of the latter, said Bowden casing end and the cable drum means being displaceably supported relative to one another in the direction of the drum axis in such a manner that with a rotation of the cable drum means, the instantaneous cable starting point of the cable section at the drum means assumes always essentially the same axial position in relation to the drum axis as the connecting means, and means movably supporting the connecting means at the housing means essentially parallel to the drum axis.

3. A Bowden cable-window lifter according to claim 2, wherein the connecting means includes a slide member which abuts at a slide surface of the housing means, and wherein said entrainment nose portion is provided at the slide member.

4. A Bowden cable-window lifter according to claim 3, wherein the connecting means includes a rigid casing extension which terminates within the area between the slide surface and the cable starting point, and wherein said entrainment nose portion is provided at the casing extension.

5. A Bowden cable-window lifter comprising cable drive means including housing means and cable drum means having helical cable grooves and supported in said housing means, entrainment means carrying a window which is movably supported in the lifting direction at a guide means, and cable means starting from the cable drum means to the entrainment means and guided back to the drum means, at least one of the cable sections extending between the housing means and the guide means being guided in a Bowden casing means, connecting means supporting one Bowden casing end at the housing means, said connecting means being taken along by the cable drum means during rotation of the latter, said Bowden casing end and the cable drum means being displaceably supported relative to one another in the direction of the drum axis in such a manner that with a rotation of the cable drum means, the instantaneous cable starting point of the cable section at the drum means assumes always essentially the same axial position in relation to the drum axis as the connecting means, and means movably supporting the connecting means at the housing means essentially parallel to the drum axis, and further comprising an entrainment member supported at the cable drum means and engaging in cable grooves, which is coupled with the connecting means.

6. A Bowden cable-window lifter according to claim 5, wherein the entrainment member is formed by a wire loop which is placed about the cable drum means into one of the cable groove threads of the at least two-threaded cable drum means and whose other end is coupled with the connecting means.

7. A Bowden cable-window lifter according to claim 6, wherein the other end of the wire loop is coupled with the connecting means of the second Bowden casing means.

* * * * *